US009199116B1

(12) United States Patent
Huang et al.

(10) Patent No.: US 9,199,116 B1
(45) Date of Patent: Dec. 1, 2015

(54) EXERCISE DEVICE PROVIDING ADJUSTABLE PACE LENGTH

(71) Applicant: Dyaco International Inc., Taipei (TW)

(72) Inventors: Hsuan-Fu Huang, Taipei (TW); Han-Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 0 days.

(21) Appl. No.: 14/497,025

(22) Filed: Sep. 25, 2014

(30) Foreign Application Priority Data

Aug. 25, 2014 (TW) ..... 103129132 A

(51) Int. Cl.
*A63B 22/00* (2006.01)
*A63B 22/04* (2006.01)

(52) U.S. Cl.
CPC ..... *A63B 22/04* (2013.01)

(58) Field of Classification Search
USPC ..... 482/1–148
See application file for complete search history.

(56) References Cited

U.S. PATENT DOCUMENTS 3,432,164 A * 3/1969 Deeks ..... A61H 1/02 482/51
5,611,758 A * 3/1997 Rodgers, Jr. ..... A63B 22/001 482/51
5,947,872 A * 9/1999 Ryan et al. ..... A63B 22/001 482/51
6,689,019 B2 * 2/2004 Ohrt et al. ..... A63B 21/154 482/52
7,621,848 B1 * 11/2009 Stearns et al. ..... A63B 22/001 482/52
7,811,205 B2 * 10/2010 Graber ..... A63B 21/015 482/51
7,927,258 B2 * 4/2011 Irving et al. ..... A63B 21/015 482/51
8,162,337 B2 * 4/2012 Teal et al. ..... B62K 3/002 280/221
8,419,598 B2 * 4/2013 Dyer et al. ..... A63B 22/0007 482/51
8,840,529 B2 * 9/2014 Chen ..... A63B 22/001 482/52
2007/0042871 A1 2/2007 Wu et al.
2012/0322624 A1 12/2012 Wu

FOREIGN PATENT DOCUMENTS

CN 201572487 U 9/2010
CN 201921387 U 8/2011
CN 203763774 U 8/2014
EP 2537566 A1 12/2012
TW M284406 U 1/2006
TW M403355 U 5/2011
TW M458233 U 8/2013

OTHER PUBLICATIONS

PCT International Search Report dated May 26, 2015 in related PCT Application No. PCT/CN2014/000853.

* cited by examiner

*Primary Examiner* — Stephen Crow
(74) *Attorney, Agent, or Firm* — Donald E. Stout; Stout, Uxa & Buyan, LLP

(57) ABSTRACT

An exercise device comprises a frame, a rotational mechanism, a left and a right coupling mechanism, and a pace-adjusting mechanism. A supporting structure is upwardly extended from the front end of the frame. The rotational mechanism is arranged at the supporting structure. The left and right coupling mechanisms are arranged at a side of the supporting structure, respectively. One end of the left and right coupling mechanism couples to the rotational mechanism, and the other end respectively comprise a left and a right pedal assembly for making a moving path. The pace-adjusting mechanism comprises a left and a right linkage assembly, a left and a right swing assembly, and a driving device. The pace-adjusting mechanism can alter the pace length of the left and right pedal assembly.

9 Claims, 8 Drawing Sheets

2

2

EXERCISE DEVICE PROVIDING ADJUSTABLE PACE LENGTH

CROSS-REFERENCE TO RELATED APPLICATIONS

The entire contents of Taiwan Patent Application No. 103129132, filed on Aug. 25, 2014, from which this application claims priority, are incorporated herein expressly by reference.

BACKGROUND OF THE INVENTION

1. Field of the Invention

The present invention relates to an exercise device, and more particularly relates to an exercise device providing adjustable pace length.

2. Description of Related Art

An elliptical trainer, also called a cross-trainer or an X-trainer, is a stationary exercise machine to simulate stair climbing, walking, or running.

The elliptical trainer does not cause excessive pressure to the joints as the two legs simultaneously share the burden, hence decreasing the risk of impact injuries.

The elliptical trainer typically includes two pedals. A user steps on the pedals and the operation of the elliptical trainer cause the pedals to provide a moving path. For conventional elliptical trainers, the moving path of the pedals is invariable.

A Taiwan Patent, Publication No., M403355, entitled "Rising Device for Elliptical Trainers," discloses an elliptical trainer with a rising device that can adjust the path of the pedals. However, the distance between the two pedals, i.e., the pace length, is still fixed.

FIG. 1 shows an elliptical trainer 1 having a fixed pace length of 20 inches. Because the users have varied heights, the elliptical trainer 1 could not suitable to all users, and the optimum training effect cannot be achieved.

SUMMARY OF THE INVENTION

In one general aspect, the present invention relates to an exercise device, and more particularly relates to exercise device providing elliptical or elliptical-like paths and adjustable pace lengths.

In an embodiment of the present invention, an exercise device is provided with a frame, a rotational mechanism, a left coupling mechanism and a right coupling mechanism, and a pace-adjusting assembly. The frame comprises a supporting structure extended upward from a top portion of the frame. The rotational mechanism is placed at the supporting structure. The left coupling mechanism and the right coupling mechanism are respectively arranged at a side of the supporting structure. The left coupling mechanism and the right coupling mechanism has an end coupled with the rotational mechanism and another end coupled with a left pedal assembly and a right pedal assembly, respectively. The pace-adjusting assembly comprises a left linkage structure and a right linkage structure, a left swing structure and a right swing structure, and a driving device. The left linkage structure and the right linkage structure have an end coupled with the supporting structure and another end coupled with the left pedal assembly and the right pedal assembly, respectively. The left swing structure and the right swing structure comprises a wheel assembly through which the left linkage structure or the right linkage structure passes, and the left swing structure and the right swing structure have an end coupled with the supporting structure and another end coupled with the left pedal assembly and the right pedal assembly, respectively. The driving device couples with the left swing structure and the right swing structure for lifting or lowering the left swing structure and the right swing structure so as to determine a pace length.

DETAILED DESCRIPTION OF THE PREFERRED EMBODIMENT

Figure 1:
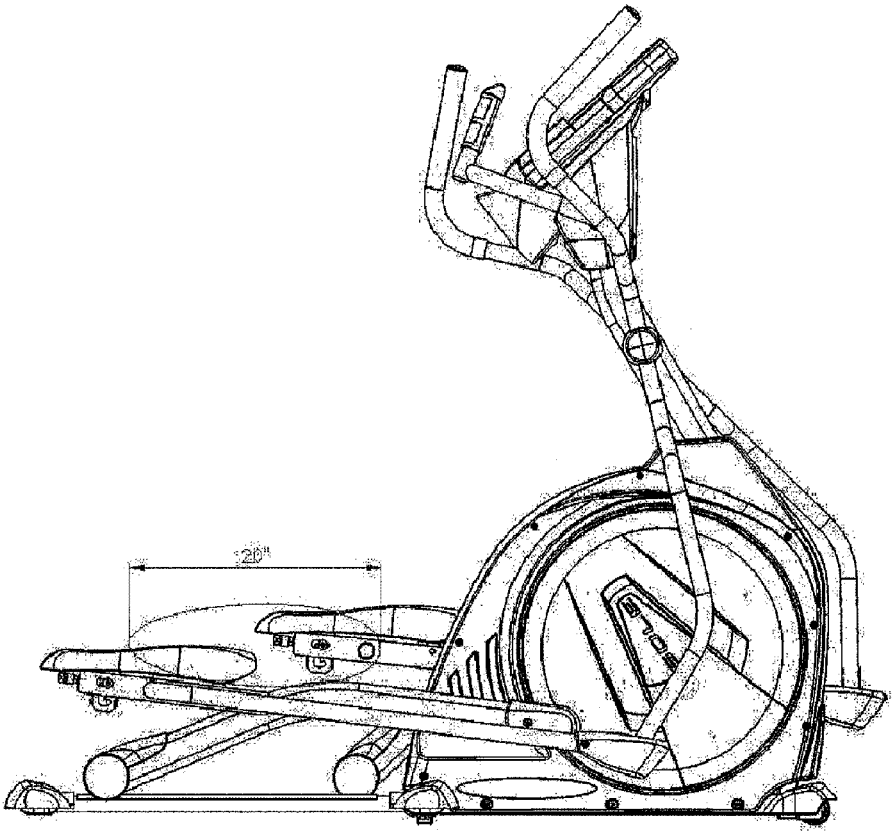
FIG.1(PRIOR ART)
FIG. 1 is a front view showing a fixed pace length of conventional elliptical trainers.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Referring to FIGS. 2-5, a preferred embodiment of the present invention provides an exercise device 2 such as an elliptical trainer 2 in which the pace length can be adjusted. The elliptical trainer 2 comprises a frame 10, a left/right coupling mechanism 20*a*/20*b*, a left/right pace-adjusting mechanism 30*a*/30*b*, and a rotational mechanism 40.

Figure 2:
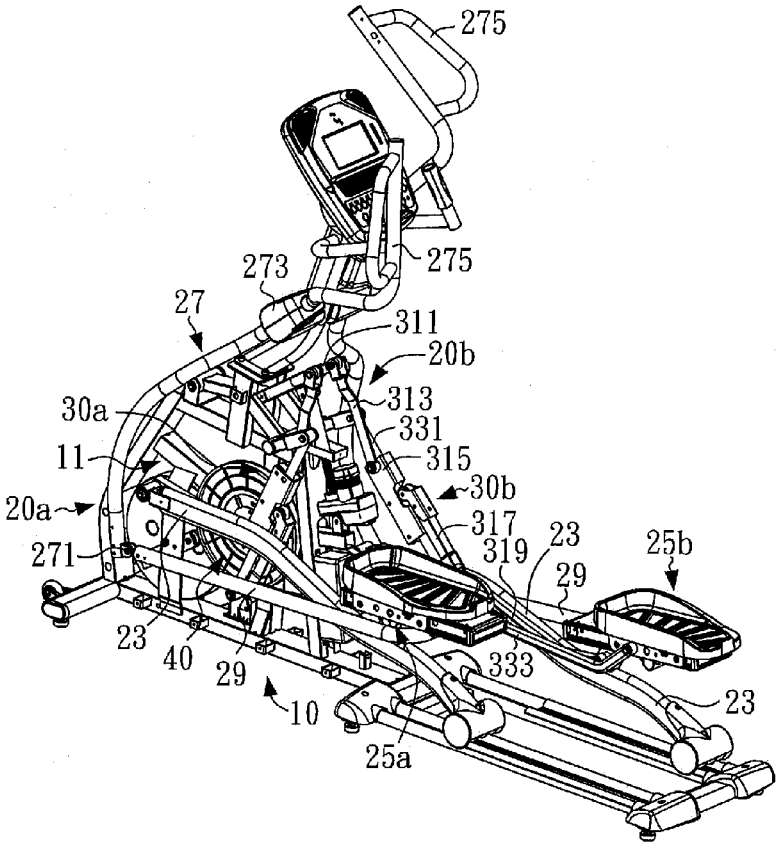
FIG. 2 is a front view showing an exercise device according to a preferred embodiment of the present invention.

As shown in FIG. 2, the left coupling mechanism 20*a* and the right coupling mechanism 20*b* have the same structure and are symmetrically arranged, in which "a" and "b" denote the left and right components respectively and may be omitted for simplicity. For example, the left coupling mechanism

20*a* and/or the right coupling mechanism 20*b* can be referred to collectively as the coupling mechanism 20, the left pace-adjusting mechanism 30*a* and/or the right pace-adjusting mechanism 30*b* can be referred to collectively as the pace-adjusting mechanism 30, and so on. In addition, FIGS. 3-5 merely show the right coupling mechanism 20*b* and the right pace-adjusting mechanism 30*b*, and omit the left coupling mechanism 20*a* and the left pace-adjusting mechanism 30*a* for clarity.

Figure 3:
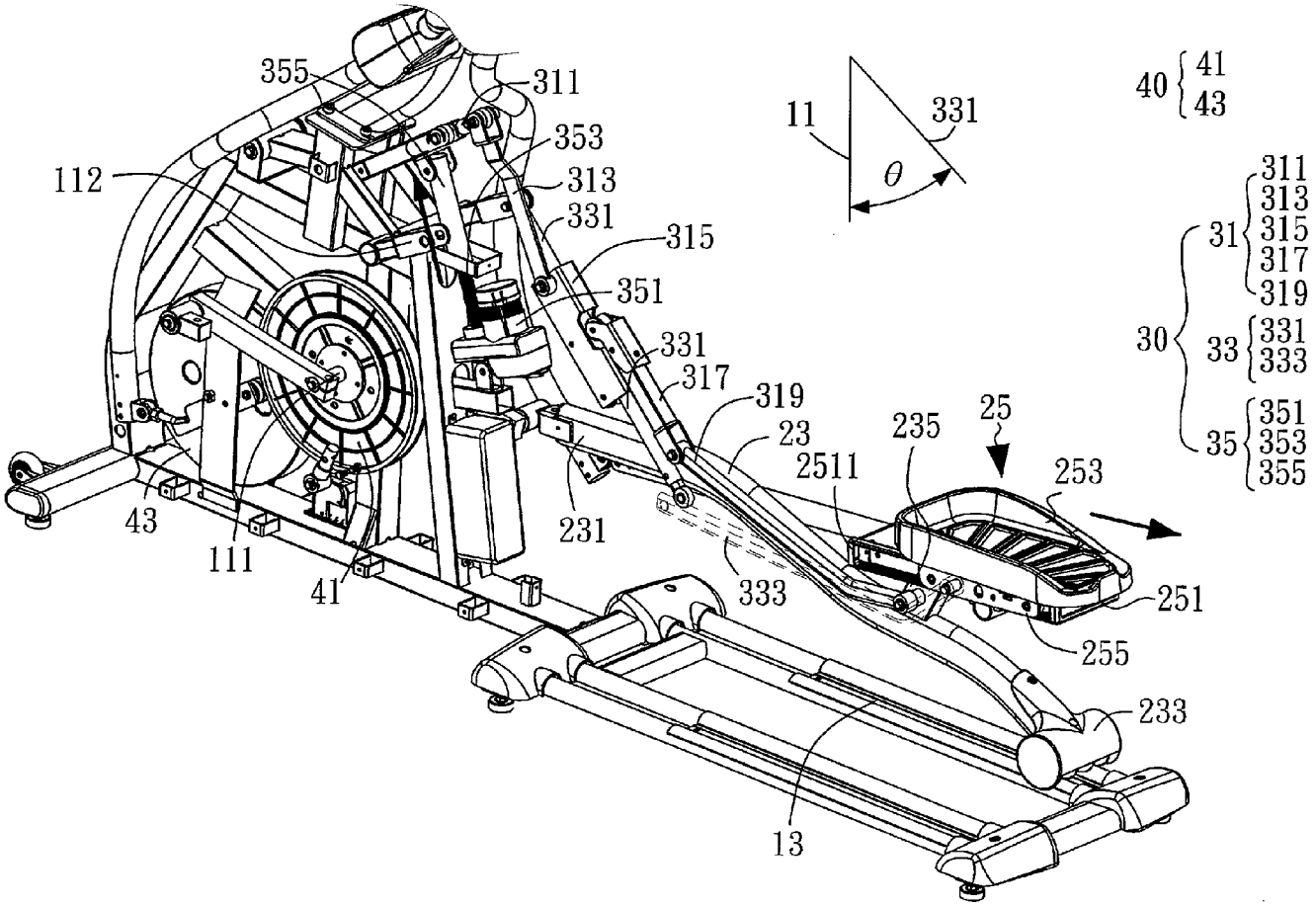
FIG. 3 is a partially enlarged and simplified view showing the exercise device according to the preferred embodiment of the present invention.

As shown in FIGS. 2 and 3, the frame 10 is arranged on a supporting surface or ground. A supporting structure 11 is upwardly extended from the top of a front portion of the frame 10. The supporting structure 11 means stationary fixing mechanisms arranged at the front portion of the frame 10, for fixing the rotation mechanism 40, the coupling mechanism 40, the pace-adjusting mechanism 30, control panel, and the likes. The rear portion of the frame 10 has two tracks 13. The supporting structure 11 comprises an axis 111, and the left coupling mechanism 20*a* and the right coupling mechanism 20*b* are respectively arranged at a side of the supporting structure 11. The left coupling mechanism 20*a* and the light coupling mechanism 20*b* may comprise a crank 21, a supporting arm 23, a pedal assembly 25, a handrail 27, and a linkage 29, respectively. The supporting arm 23 may comprise a pivot portion 231, a sliding portion 233, and a supporting portion 235. The crank 21 has two ends, in which one end rotationally connected to the axis 111 and the other end pivotally coupled to the pivot portion 231 of the supporting arm 23. The sliding portion 233 is capable of sliding on the track 13 of the frame 10. Each pedal assembly 25 comprises a base 251, a pedal 253, and a slider 255. The base 251 pivotally connected with the supporting portion 235 and fixes with an end of the linkage 29. The handrail 27 comprises a pivot portion 271, a coupling portion 273, and a holding portion 275. The linkage 29 has two ends, in which one end couples to the base 251 of the pedal assembly and another end couples to the pivot portion 271 of the handrail 27. The holding portion can be held by the user's hand. The coupling portion 273 pivotally couples with the supporting structure 11, so that the handrail 27 can swing around the coupling portion 273.

As shown in FIGS. 2 and 3, the rotational mechanism 40 is arranged at the supporting structure 11 and connects with the left and right pedal assembly 25*a*/25*b* via the left coupling mechanism 20*a* and the right coupling mechanisms 20*a*/20*b*, respectively. The user drives the rotational mechanism 40 via the pedal assembly 25, which will make a moving path, e.g., an elliptical or elliptical-like moving path. The rotational mechanism 40 may comprise, but is not limited to, a driving wheel 41 and a flywheel 43. The driving wheel 41 pivotally couples with the axis 111 of the supporting structure 11, and can be driven by the crank 31. The flywheel 43 couples to the front portion of the frame 10. In this preferred embodiment, the driving wheel 41 employs a coupling member (not shown), such as a belt, as a medium to drive the flywheel 43.

As shown in FIGS. 2 and 3, each pace-adjusting mechanism 30, i.e., the left or the right pace-adjusting mechanism, comprises a swing structure 31, a linkage structure 33, and a driving device 35. Each swing structure 31 comprises a head structure 311, a first swing arm 313, a wheel assembly 315, a second swing arm 317, and a third swing arm 319. The linkage structure 33 comprises a first linkage arm 331 and a second linkage arm 333. The driving device 35 can lift or lower the swing structure 31. In this preferred embodiment, the driving device 35 may comprise, but is not limited to, a motor 351, a screw 353, and an internally-thread tube 355. The internally-thread tube 355 has an end coupled with the head structure 311. The internally-thread tube 355 couples with the screw 353 via its thread. The motor 351 can drive the screw 353 to rotate, making the internally-thread tube 355 moving along with the screw 353 in a direction of approaching or leaving the motor 351.

As shown in FIGS. 2 and 3, the head structure 311 has two ends in which one end couples the supporting structure 11 and the other end couples to an end of the first swing arm 313. In addition, a portion between two ends of the head structures pivotally couples with the internally-thread tube 355 of the driving device 35. The first swing arm 313 has two ends, in which one end couples with head structure 311, and the other end couples with an end of the wheel assembly 315, which fixes with the second swing arm 317. The second swing arm 317 has two ends, in which one end couples to the wheel assembly 315 and the other end couples to an end of the third swing arm 319. The third swing arm 319 has two ends, in which one end couples with second swing arm 317, and the other end pivotally couples with the supporting portion 235. The wheel assembly 315 is a hollowed structure and the first linkage arm 331 passes through the wheel assembly 315. The first linkage arm 331 has two ends, in which one end pivotally couples with a lever 112 of the supporting structure 11 and the other end couples with the second linkage arm 333. The second linkage arm 333 has two ends, in which one end pivotally couples with the first linkage arm 331 and the other end pivotally connects with the slider 255. The slider 255 fixes with the pedal 253, and the base 251 comprises a track 2511 on which the slider 255 can move forward or backward.

Figure 6:
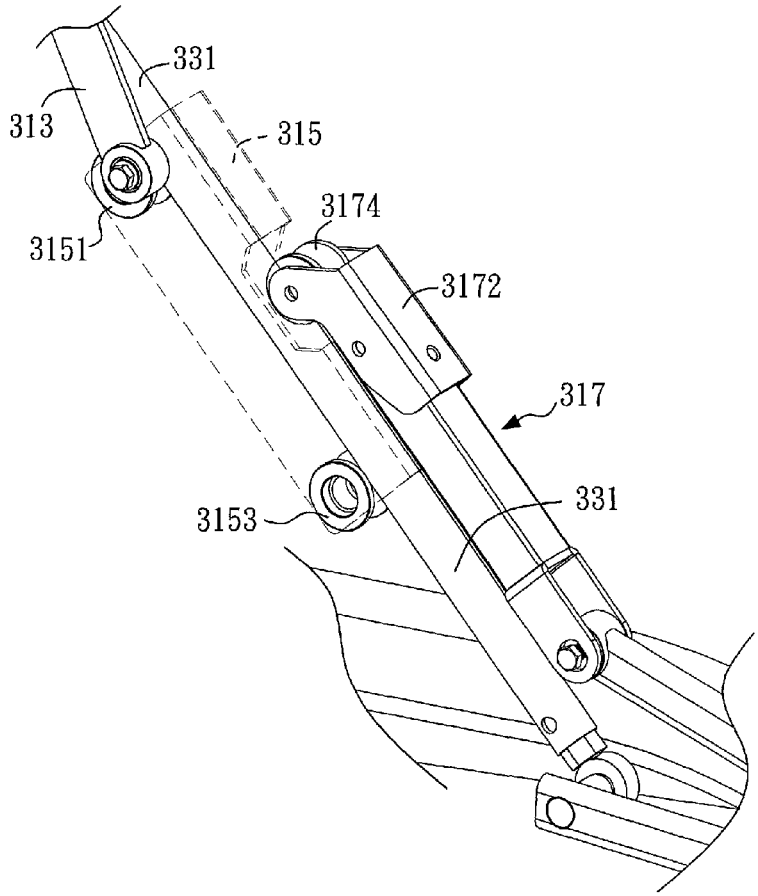
FIG. 6 is a partially enlarged view showing a wheel assembly of the exercise device according to the preferred embodiment of the present invention.

FIG. 6 is a partially enlarged view showing the detail of the wheel assembly 315 according to the preferred embodiment of the present invention. As mentioned above, the wheel assembly 315 has a hollowed housing coupled with the second swing arm 317, and the first linkage arm 331 passes through the hollowed housing. In addition, the wheel assembly 315 may have a plurality of wheels against the first linkage arm 331, so that the wheel assembly 315 can slide along the first linkage arm 331 smoothly. For example, the wheel assembly 315 may have a first wheel 3151 and a second wheel 3153. In addition, the second swing arm 317 may have a hook 3172 pivotally coupled with an end of the second swing arm 317, and the hook 3172 has a third wheel 3174 against the first linkage arm 331. Where the first wheel 3151 and the second wheel 3153 are arranged at a side of the first linkage arm 331, and the third wheel 3174 is arranged at the other side of the first linkage arm 331, so that the first linkage arm 331 are sandwiched by the first wheel 3151, the second wheel 3153, and the third wheel 3174. Modification may be made for the wheel assembly 315. In other embodiments, the number of the wheel is not limited, and the wheel assembly 315 could have different configuration.

Figure 4:
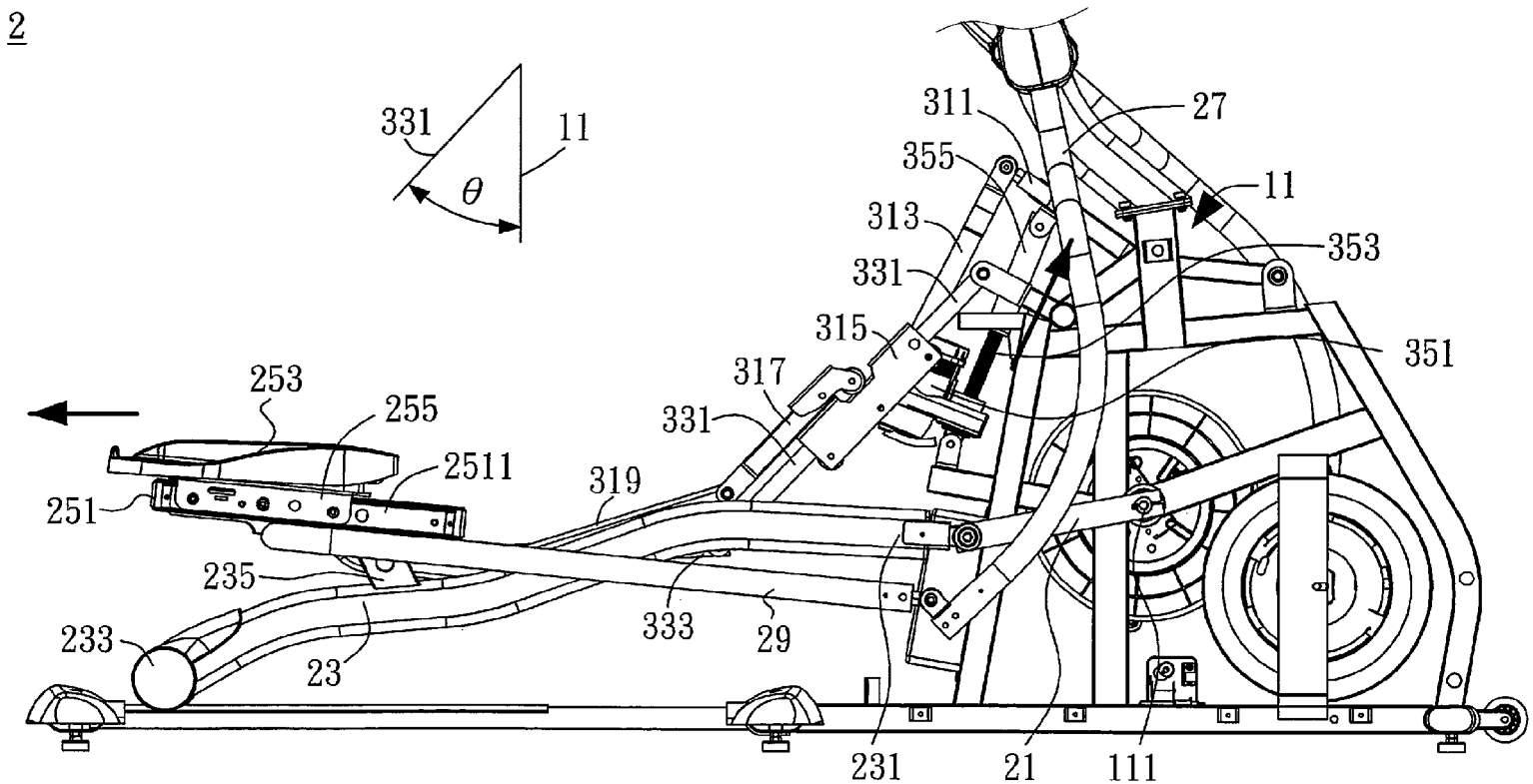
FIGS. 4-5 are side partial views showing the operations of the exercise device according to the preferred embodiment of the present invention.

Referring to FIGS. 3 and 4, when the motor 351 drives the screw 353 to rotate and thus make the internally-threaded tube 355 moving away from the motor 351, the internally-threaded tube 355 will push the head structure 311 to raise. By doing so, the wheel assembly 315 will be lifted along the first linkage arm 331 and thus pulls the first linkage arm 331 and the second linkage arm 333, such that the first linkage arm 331 and the second linkage arm 333 will extend toward the rear end of the exercise device, resulting in an angle θ between the first linkage arm 331 and the vertical direction of the supporting structure 11 to be increased, and the slider 255 carried by the second linkage arm 333 being moved backward along the track 2511, as shown by the arrow.

Figure 5:
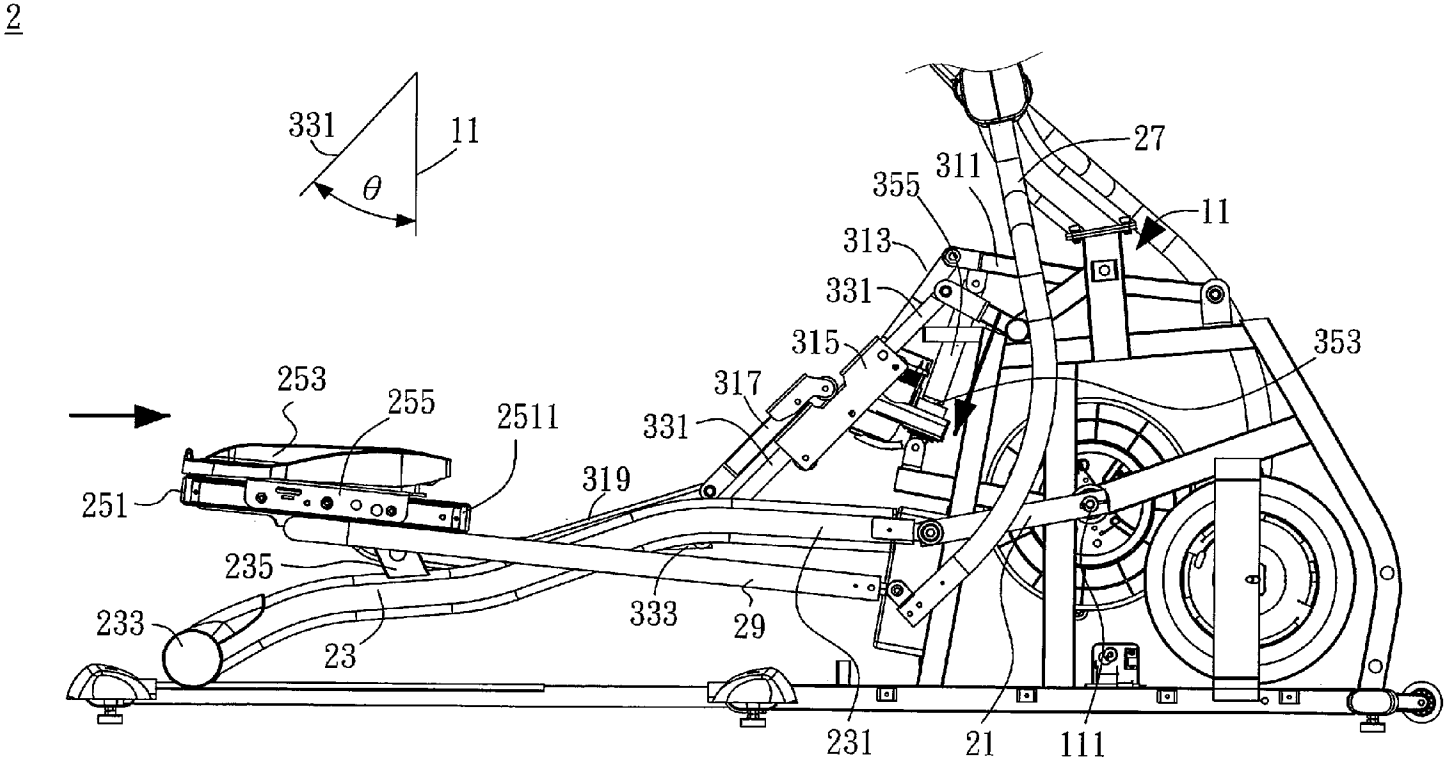

Referring to FIG. 5, when the motor 351 drives the screw 353 to rotate and thus make the internally-threaded tube 355 moving toward the motor 351, the internally-threaded tube 355 will pull and lower the head structure 311. By doing so, the wheel assembly 315 will be lowered along the first linkage arm 331 and thus pulls the first linkage arm 331 and the second linkage arm 333, such that the first linkage arm 331 and the second linkage arm 333 will be drawn toward the front end of the exercise device, resulting in an angle θ between the first linkage arm 331 and the vertical direction of the supporting structure 11 to be decreased, and the slider 255 carried by the second linkage arm 333 being moved forward along the track 2511.

Figure 7:
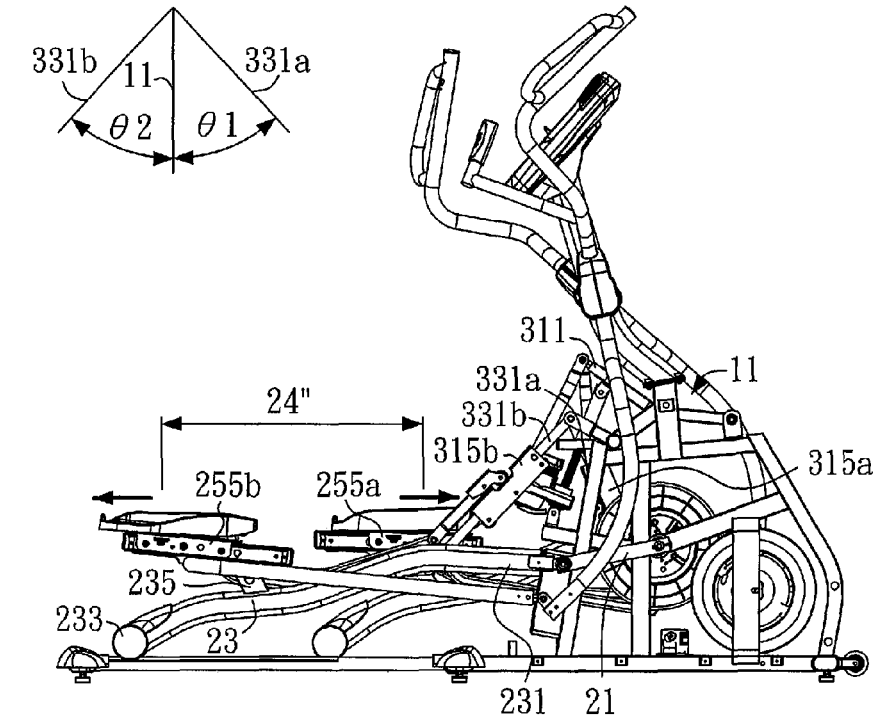
FIGS. 7-8 are side views respectively showing two pace lengths of the exercise device according to the preferred embodiment of the present invention.
Figure 8:
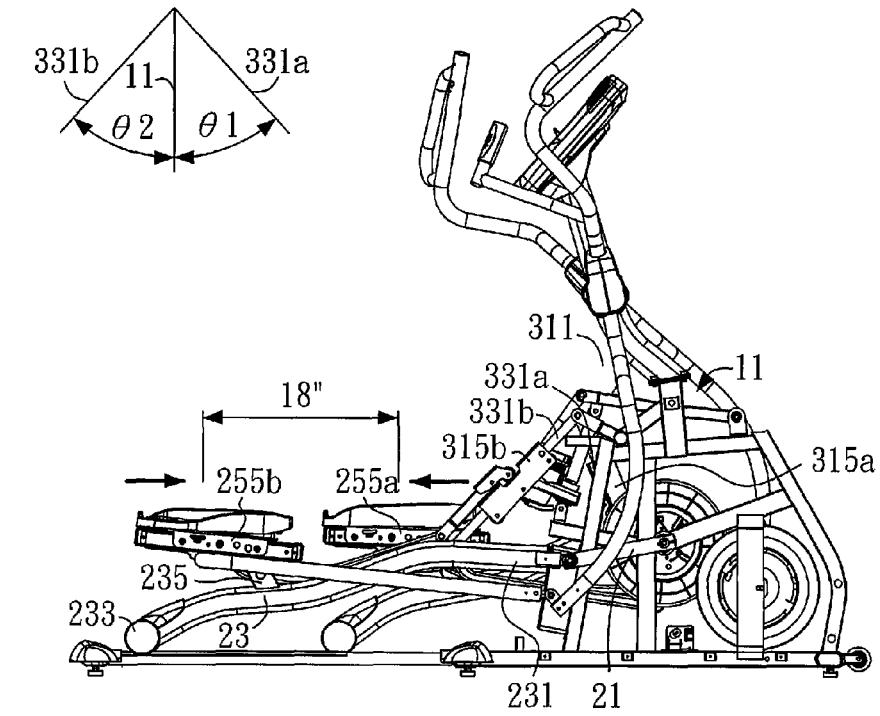

FIGS. 3, 4, and 5 merely show the right swing structure 31 and the right linkage structure 33, and omit the left swing structure 31 and the left linkage structure 33. FIG. 7 and FIG. 8 show both of the left and right swing structure 31 and left/right swing structure 33. As shown in FIG. 7, when the head structure 33 is lifted, the angle θ1 between the left linkage arm 331*a* and the vertical direction of the supporting structure 11 is increased, and the angle θ2 between the right linkage arm 331*b* and the vertical direction of the supporting structure 11 is increased, too. As a result, the slider 255*a* moves forward, and the slider 255*b* moves backward. Therefore, the pace length between the two pedals is increased, e.g., increased to 24 inches.

As shown in FIG. 8, when the head structure 33 is lowered, the angle θ1 between the left linkage arm 331*a* and the vertical direction of the supporting structure 11 is decreased, and the angle θ2 between the right linkage arm 331*b* and the vertical direction of the supporting structure 11 is decreased, too. As a result, the slider 255*a* moves backward, and the slider 255*b* moves forward. Therefore, the pace length between the pedals is decreased, e.g., decreased to 18 inches.

FIG. 7 shows the exercise device 2 with a maximum pace length, while FIG. 8 shows the exercise device 2 with a minimum pace length. By adjusting the position of the internally-threaded tube 355, the pace length can be adjusted between the maximum and the minimum.

Because the left and right swing structures 31 and the left and right linkage structures 33 are placed between the supporting structure 11 and the pedal assembly 25 and not couple with the cranks 21. Therefore, when changing the pace length, the transverse diameter of the elliptical or elliptical-like moving path will be increased or decreased, and the user needs not to raise his or her legs. The posture is ergonomic and the device can fit varied users.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a frame with a supporting structure extended upward from a front portion of the frame;

a rotational mechanism placed at the supporting structure;

a left coupling mechanism and a right coupling mechanism respectively arranged at a side of the supporting structure, the left coupling mechanism and the right coupling mechanism having an end coupled with the rotational mechanism and another end coupled with a left pedal assembly and a right pedal assembly, respectively;

a pace-adjusting assembly comprising:

a left linkage structure and a right linkage structure having an end coupled with the supporting structure and another end coupled with the left pedal assembly and the right pedal assembly, respectively;

a left swing structure and a right swing structure each comprising a wheel assembly through which the left linkage structure or the right linkage structure passes and having an end coupled with the supporting structure and another end coupled with the left pedal assembly and the right pedal assembly, respectively; wherein the wheel assembly comprises a hollowed housing through which the left linkage structure or the right linkage structure passes and has a plurality of wheels which engage the left linkage structure or the right linkage structure;

and a driving device coupled with the left swing structure and the right swing structure for lifting or lowering the left swing structure and the right swing structure so as to determine a pace length.

2. The exercise device of claim 1, wherein the plurality of wheels are arranged at two sides of the left linkage structure or the right linkage structure, so that the left linkage structure or the right linkage structure is sandwiched by the plurality of wheels.

3. The exercise device of claim 1, wherein the left swing structure and the right swing structure further comprises a head structure, a first swing arm, a second swing arm, and a third swing arm, wherein the head structure has two ends in which one end couples the supporting structure and the other end couples with an end of the first swing arm, the first swing arm comprises two ends in which one end couples to the head structure and the other end couples to an end of the wheel assembly, the second swing arm has two ends in which one end couples to the wheel assembly and an end of the third swing arm, and the third swing arm has two ends in which one end coupled with the second swing arm and the other end couples with the left or right pedal assembly.

4. The exercise device of claim 3, wherein the left linkage structure and the right linkage structure respectively comprise a first linkage arm and a second linkage arm, the first linkage arm passes through the wheel assembly and has two ends in which one end pivotally couples with the supporting structure and the other end couples with an end of the second linkage arm, and the second linkage arm has two ends in which one end couples with the first linkage arm and the other end couples to the left or right pedal assembly.

5. The exercise device of claim 4, wherein the left pedal assembly and the right pedal assembly respectively comprise a base, a pedal, and a slider, wherein the slider is fixed with the pedal and can be slid forward or backward on a track of the base, and the slider is coupled to an end of the second linkage arm.

6. The exercise device of claim 3, wherein the driving device comprises a motor, a screw, and an internally-threaded tube with an end coupled to the head structure.

7. The exercise device of claim 6, wherein the internally-threaded tube has thread to engage the screw, and the motor drives the screw to make the internally-threaded tube moving along the screw in a direction approaching to or leaving away the motor.

8. The exercise device of claim 1, wherein the supporting structure comprises an axle, and the left coupling mechanism and the right coupling mechanism respectively comprise a crank, a supporting arm, a pedal assembly, a handrail, and a linkage, in which the supporting arm comprise a pivot portion, a sliding portion, and a supporting portion, the crank has two ends in which one end connects to the axle and the other end pivotally coupled to the pivot portion of the supporting arm, the sliding portion is capable of sliding on the frame, and the handrail comprises a pivot portion, a coupling portion, and a holding portion, in which the linkage has an end which couples to the pedal assembly and another end which couples to the pivot portion of the handrail, the holding portion can be held by a user's hand, and the pivot portion pivotally couples with the supporting structure.

9. The exercise device of claim 8, wherein the rear portion of the frame comprises a track, and the sliding portion is capable of sliding on the track of the frame.

* * * * *